US007195194B2

(12) United States Patent
Meyer et al.

(10) Patent No.: US 7,195,194 B2
(45) Date of Patent: Mar. 27, 2007

(54) PROCESS FOR AUTOMATIC REMOVAL OF PACKAGES

(75) Inventors: Clement Meyer, Bernwiller (FR); Guy Schueller, Kingersheim (FR)

(73) Assignee: Superba S.A.S., Mulhouse (FR)

( * ) Notice: Subject to any disclaimer, the term of this patent is extended or adjusted under 35 U.S.C. 154(b) by 203 days.

(21) Appl. No.: 10/614,028

(22) Filed: Jul. 8, 2003

(65) Prior Publication Data

US 2005/0242226 A1 Nov. 3, 2005

Related U.S. Application Data

(60) Provisional application No. 60/396,572, filed on Jul. 18, 2002.

(30) Foreign Application Priority Data

Jul. 8, 2002 (FR) ..... 02 08563

(51) Int. Cl.
*B65H 67/04* (2006.01)

(52) U.S. Cl. ..... 242/473.8

(58) Field of Classification Search ..... 242/473.5, 242/473.4, 473.7, 473.8, 473.9, 473.6, 154, 242/417.2, 486.3, 474.6, 475.8
See application file for complete search history.

(56) References Cited

U.S. PATENT DOCUMENTS 3,940,076 A 2/1976 Kato et al.
5,179,828 A 1/1993 Stahlecker
5,326,039 A * 7/1994 Tanae et al. ..... 242/473.8
5,992,790 A * 11/1999 D'Agnolo ..... 242/475.8
6,035,667 A * 3/2000 Watabe et al. ..... 65/381
6,457,668 B1 * 10/2002 Jaschke et al. ..... 242/473.8

FOREIGN PATENT DOCUMENTS

FR 2 259 776 8/1975
GB 1406817 9/1975

* cited by examiner

*Primary Examiner*—Patrick Mackey
*Assistant Examiner*—William E. Dondero
(74) *Attorney, Agent, or Firm*—Young & Thompson

(57) ABSTRACT

A process for automatically removing packages in a winding station of a yarn winding machine, having elements (1) for holding and disengaging a full package (2), a winding guide (3) guiding the yarn to be wound during winding, a bar (7) for disengagement from the winding guide (3), a package drive (4), heads (5) for gripping and holding the spool (6) and a device (8) for supplying the station with spools (6). The process includes providing, during each removal cycle, a relaxation of the tension of the supply yarn, then restarting a new winding cycle after completing the removal cycle. The invention is more particularly applicable to the field of the textile industry, in particular machines for winding yarns.

7 Claims, 6 Drawing Sheets

Fig. 2
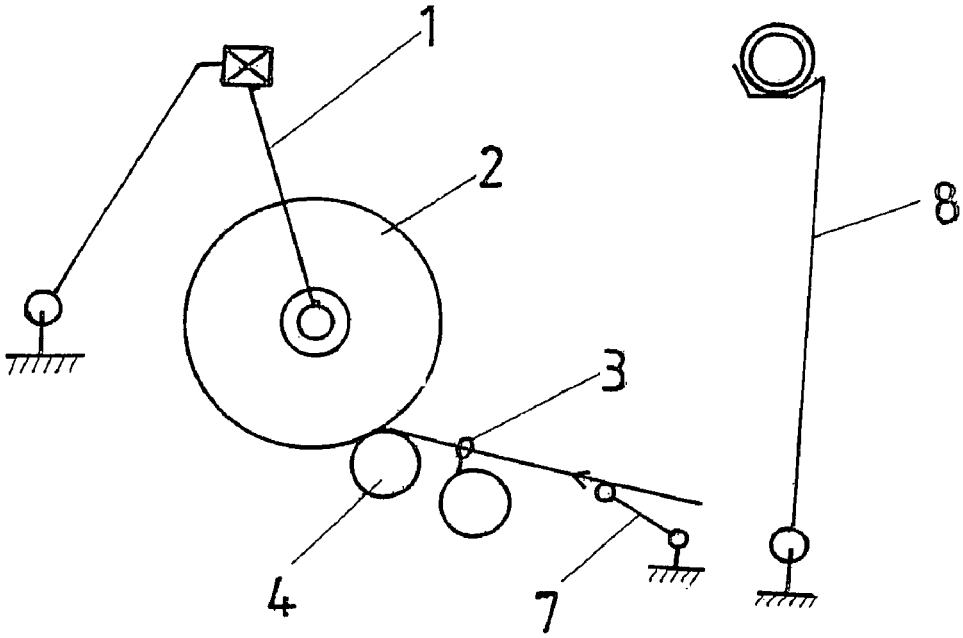
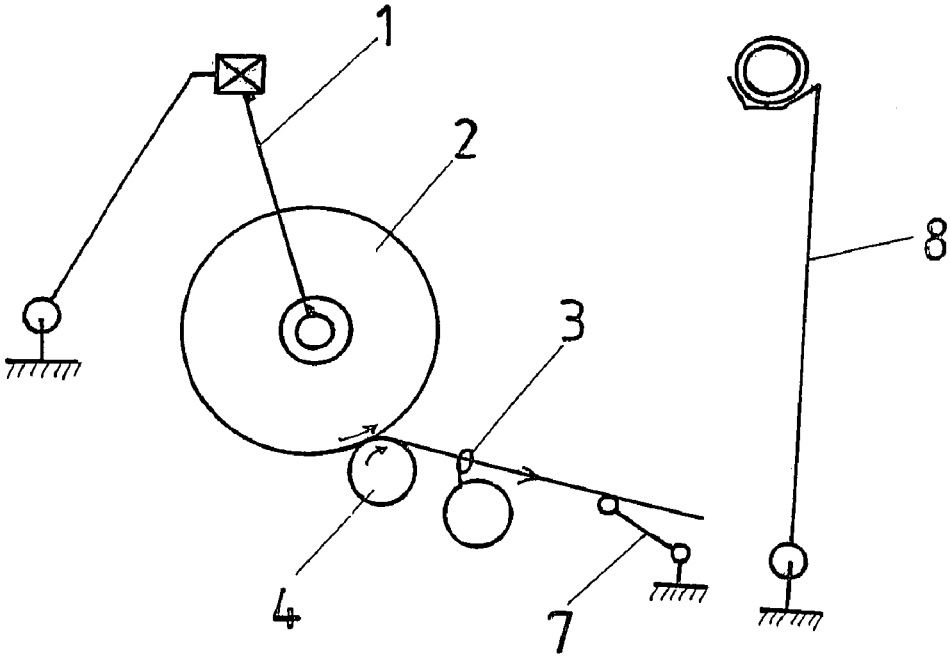
Fig. 3

Fig. 4
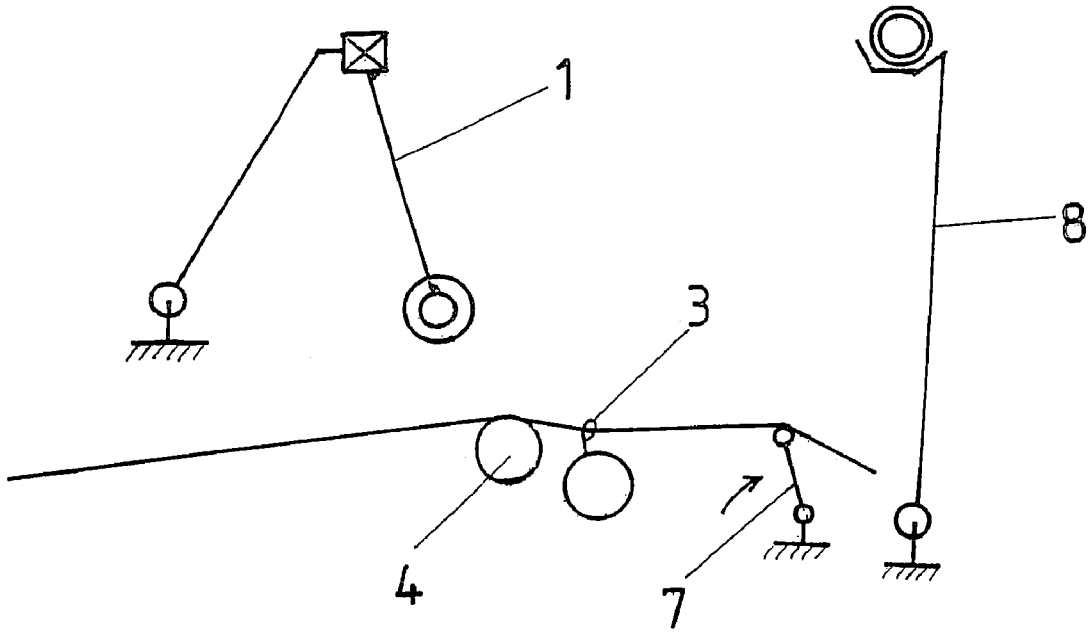
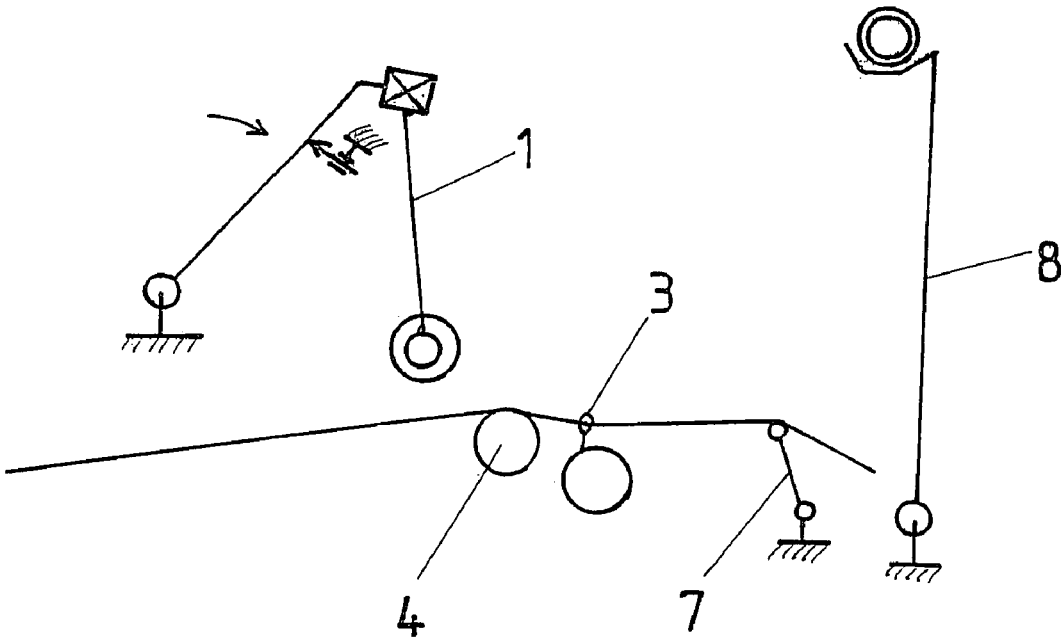
Fig. 5

Fig-10
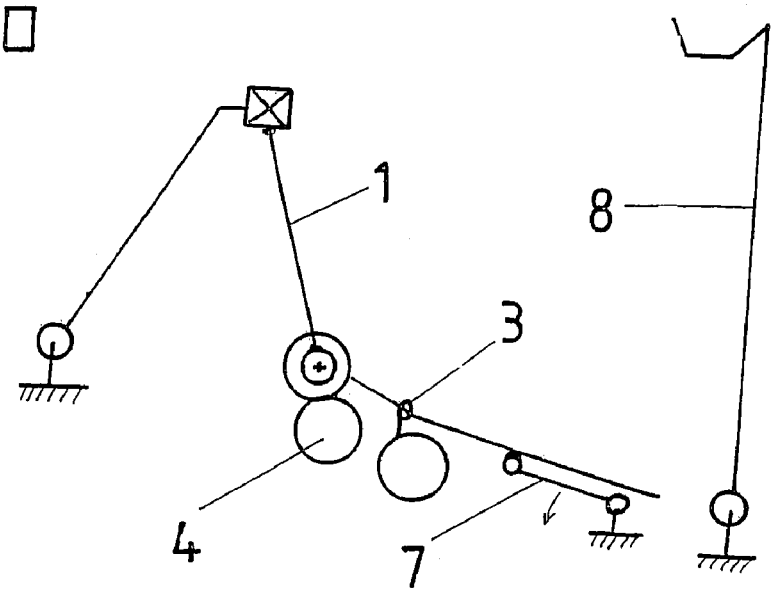
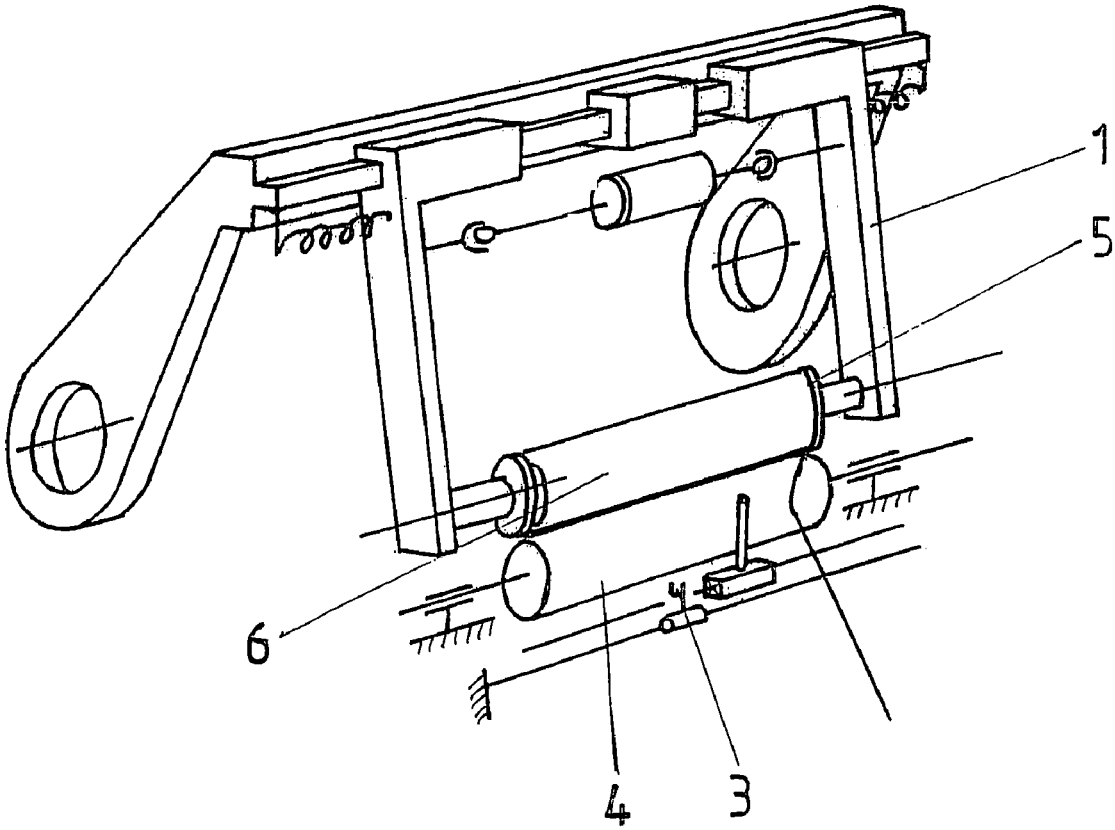
Fig-11

PROCESS FOR AUTOMATIC REMOVAL OF PACKAGES

BACKGROUND OF THE INVENTION

The present invention relates to the field of the textile industry, in particular machines for winding yarns. and has for its object a process for automatic removal of packages.

At present, when packages are full, the different motors for driving winding, the guide and the pre-feed, are cut off synchronously and each full package is disengaged from the winding machine by an automatic removal device. Such an automatic removal device grasps the full package by means of gripping arms, after disengagement of the heads holding said package, and imparts to said full package a pivotal movement during which is carried out a traction on the yarn giving rise to high tension in this latter.

This tension on the yarn can have the result either of directly leading to its breakage, or more generally risking pulling the yarn out of its securement between a gripping head for the spool and the corresponding end of the spool, after cutting the final end of the yarn of the full package. Thus, particularly in the case of use of used packages or new packages with a notch, it can result that the gripping pressure of the empty spool between the holding heads will not be sufficient to maintain a highly stretched yarn between such an end and the corresponding head, this essentially because of irregularities of the surface of said end, such that the yarn is in only partial contact with the surfaces that are gripped against each other and can thus escape from between these surfaces.

As a result, the restarting of the machine is fairly quickly interrupted, because of the detection of a running accident by the corresponding detectors of tension or of presence of a yarn. It follows that manual intervention becomes necessary, which gives rise to a loss of output of the winding machines.

To avoid these drawbacks, the operators charged with surveillance of the winding machines often take preventive manual steps consisting in pulling on the layer of supply yarn, when the different drive motors for the winding are cut off, to produce a certain slack in the yarns before and/or during removal of the full packages. Such a manual action is however relatively chancy and does not permit overcoming with certainty the problems arising from the removal of packages and the overtension of the yarns requiring moreover the presence of an operator during the removal cycle.

SUMMARY OF THE INVENTION

The present invention has for its object to overcome these drawbacks by providing a process for automatic removal of packages permitting carrying out a removal of the full package and automatic emplacement of a new empty spool, by ensuring a substantially controlled tension of the yarn during emplacement of said spool, without risking breakage of the yarn, nor its accidental disengagement before restarting the winding or during restarting.

To this end, the process according to the invention consists essentially in providing, during each removal cycle, a relaxation of the tension of the supply yarn, then restarting a new winding cycle after completion of the removal cycle.

BRIEF DESCRIPTION OF THE DRAWINGS

The invention will be better understood from the following description, which relates to a preferred embodiment, given by way of non-limiting example, and explained with reference to the accompanying schematic drawings, in which:

FIGS. 2 to 10 show schematically the process of removing the package according to the invention, and FIG. 11 is a view analogous to that of FIG. 1 upon restarting winding.

DETAILED DESCRIPTION OF THE PREFERRED EMBODIMENTS

Figure 1:
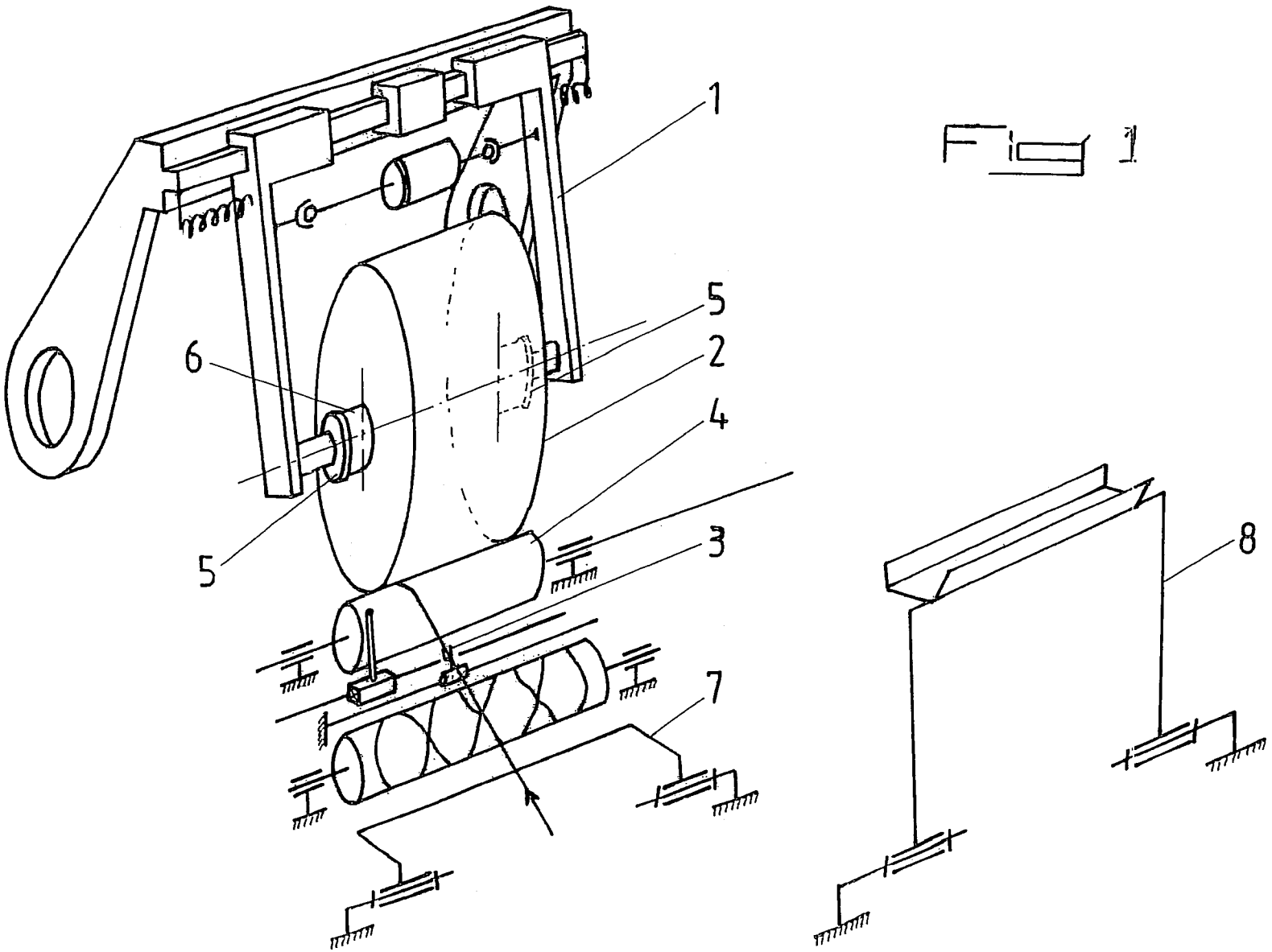
FIG. 1 is a perspective view of a winding station of a winding machine for yarn at the end of the winding of a package.

FIGS. 1 and 11 of the accompanying drawings show, by way of example, a winding station of a machine for winding yarns, comprising. means 1 for holding and disengaging a full package 2, a winding guide 3 guiding the yarn to be wound during winding, a bar 7 for disengaging from the winding guide 3, a package drive 4, heads 5 for gripping and holding the spool 6 and a device 8 for supplying the station with spools 6. In a known manner, at the end of winding a package 2, the drive of the package 4 and the drive of the winding guide 3 are stopped, as is also the pre-supply device for yarns, not shown in the accompanying drawings. As a result, the yarn has, between the full package 2 and the device for pre-supply, a yarn tension about that of or even greater than. that of winding.

During removal of the package 2, this tension is at present increased, because of the fact of elongation due to the increase in spacing between the package 2 and the winding station, as explained above. However, the invention is also applicable to different winding machines.

According to the invention, and as shown more particularly in FIGS. 2 to 10 of the accompanying drawings, the new process for automatic removal of packages consists essentially in providing, during each removal cycle, a relaxation of the tension of the supply yarn (FIGS. 3 to 6), then restarting a new winding cycle after completion of the removal cycle (FIGS. 7 to 11). Thus, the removal of the full package 2 and the disengagement of the winding guide 3 (FIG. 4), can be carried out with a controlled tension in the yarn between the full package 2 and the pre-supply device, such that the emplacement of the new spool 6 (FIG. 9), its gripping between the gripping heads 5 and the pinching of the yarn between a head 5 and one end of the spool 6, can be carried out without the yarn being subjected to tension. It follows that, during cutting of the end of the yarn of the full package, the yarn gripped against the end of the new spool 6 is held securely at this end and that at the start of the package drive 4 (FIG. 11) said yarn is perfectly wound without risk of a winding accident.

The relaxation of the tension of the supplied yarn can be carried out during stopping of winding, namely during the deceleration phase of the package or when the package is totally stopped, or else after total stoppage of the package, before disengagement of the. full package or during this disengagement or just after the disengagement.

Figure 8:
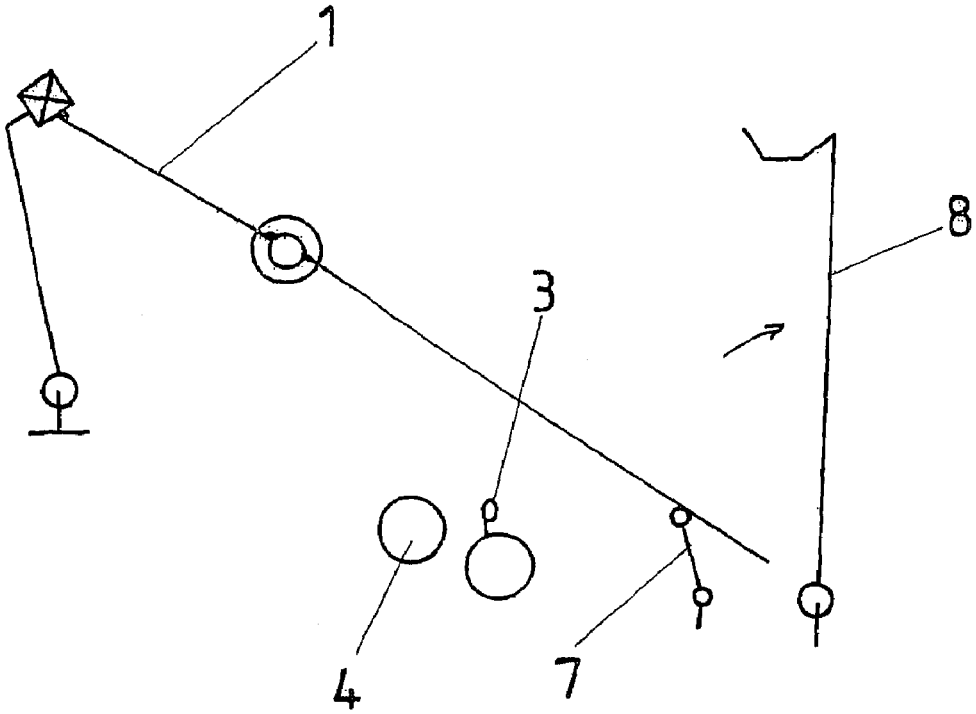
Figure 9:
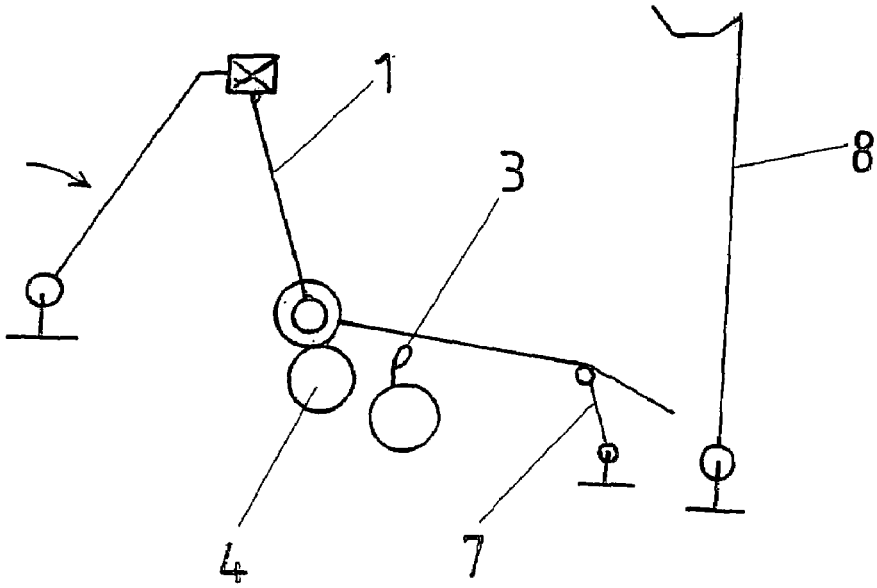

According to another characteristic of the invention, the relaxation of the tension of the supply yarn can also be carried out (FIG. 3), by a drive of the package 2 in the direction opposite the winding direction, by means of the package drive 4, which is actuated in the reverse direction, for a short period of time, by means of a mechanical, electrical, electronic or other reverser. Such a reverser is known to those skilled in the art and is not described in greater detail. A reverse rotation of the package, as specified above, for a relatively short period of time, namely one or two seconds for example, permits, after stopping the assembly of the drive motors, namely of the package drive 4, the drive of the package guide 3 and of the pre-supply device, obtaining a relaxation or slack in the yarn over a length sufficient to carry out the removal of the full package 2, the disengagement of the winding guide 3 (FIGS. 4 and 5), the introduction of the new spool 6 and the gripping of the yarn between one end of this spool 6 and a gripping head (5) of this latter (FIGS. 8 and 9). The yarn of the full package could then be cut and a new winding phase could be started (FIGS. 10 and 11), this while ensuring that the yarn will not be subjected. to any tension during all of the mentioned operations.

According to another characteristic of the invention, the relaxation of the tension in the supply yarn can be carried out, during stopping of winding, by the total stopping of the package, during the disengagement of the full package 2 by relaxation of the tension of the yarn upstream of the winding station.

Thus, according to one characteristic of the invention, not shown in the accompanying drawings, the relaxation of the tension of the supply yarn can be obtained by action on the path of the yarn upstream of the winding guide 3, the assembly of the drive motors for winding, for the winding guide and for the pre-supply, being stopped. Such a relaxation can be carried out as well before the disengagement of the full package 2 as during this disengagement.

To this end, obtaining this relaxation or slack is carried out by a relative movement of the different deflection cylinders forming the pre-supply in the direction of shortening the path of the yarn during stopping. It is also possible to act on the length of the path of the yarn by providing one or several deflection cylinders along this path, these deflection cylinders being movable out of a rectilinear path. In such a case also, the deflection cylinders can, in the winding position, be outside a rectilinear path of the yarn, such that these latter make for a longer path and, upon stopping the different drive motors, these cylinders move to a position corresponding substantially to a rectilinear path of the yarn, such that said yarn is automatically stretched. In this case in which an action is carried out on the path of the yarn upstream of winding, different means permitting obtaining the relaxation or slack by relative movement to their position during winding return automatically to their initial position during the phase of restarting winding.

The different controls for reversing the operation of the package drive 4 or the movement of the different deflecting cylinders can preferably be carried out automatically by means of a conventional programmable computer dedicated to the control and surveillance of the operation of the winding machine. Thus, the controls necessary to practice a process according to the present invention can be completely integrated into the existing control processes and hence can complete the existing programs of control and surveillance.

Figure 6:
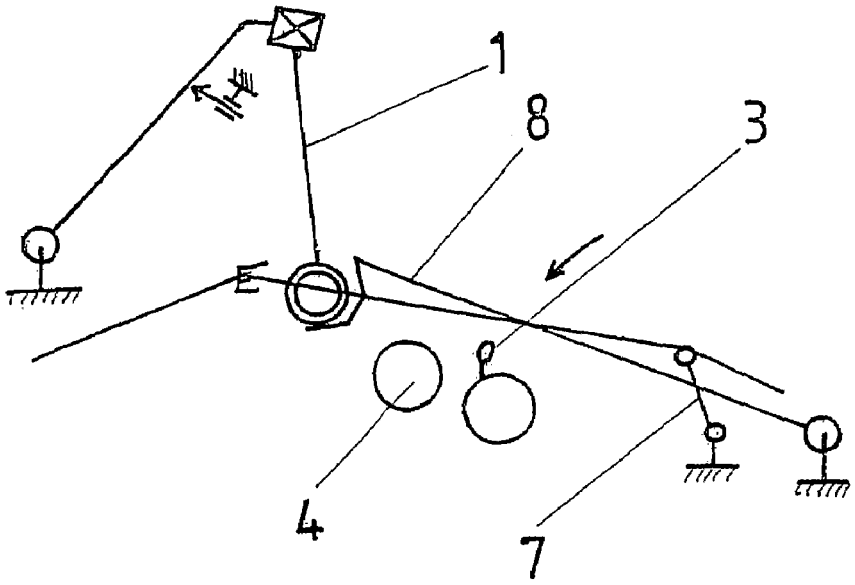
Figure 7:
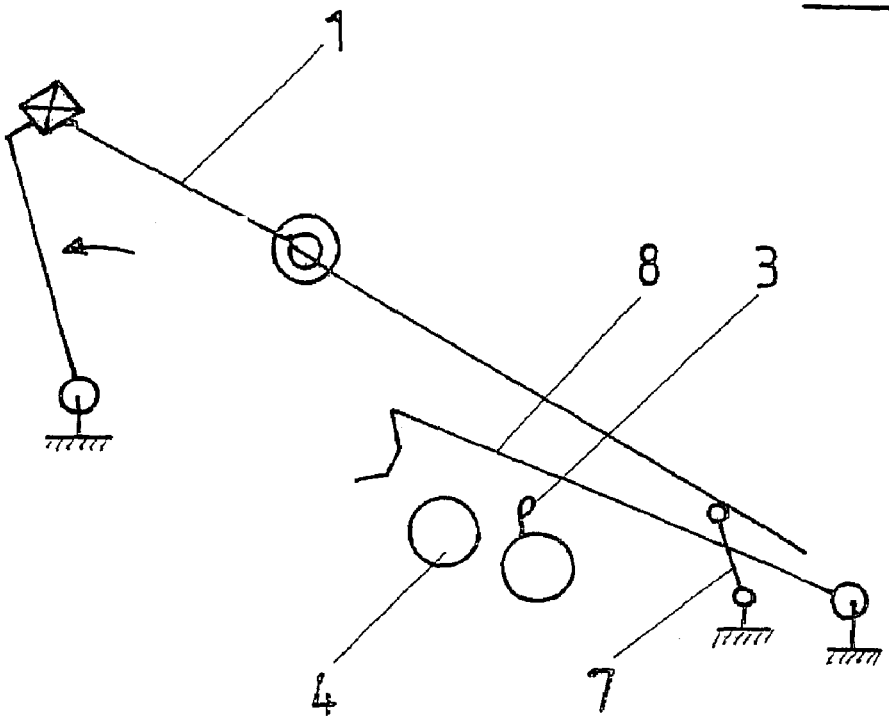

FIGS. 2 to 10 show, schematically, the essential phases of package removal according to the invention. FIG. 2 shows the stopping of the winding cycle and FIGS. 3 and 4 show a phase of relaxation of the yarns followed by disengagement of the winding guide 3 by means of the disengagement bar 7. The package carrier is then lowered (FIG. 5) and the package loader descends (FIG. 6). Then, the package carrier is raised (FIG. 7), this raising being followed by raising of the package loader or device for supplying the station with spools 6 (FIG. 8), itself followed by a descent of the package carrier (FIG. 9). The bar 7 for disengaging the winding guide 3 is then disengaged (FIG. 10). FIG. 11 shows in perspective the restarting of a new cycle of winding.

Thanks to the invention, it is possible to carry out, automatically, a package removal ensuring with certainty that the yarn will not undergo any supplemental tension during any operation of removing the full package and emplacing a new spool, such that any risk of escape of the yarn from the new spool during startup or breaking of the yarn because of excessive tension, is avoided.

Moreover, because the yarn is protected against any excessive tension, operational accidents such as breaking the yarn or escape of the yarn can be avoided, such that the output of the machine can be substantially improved.

Of course, the invention is not limited to the embodiments described and shown in the accompanying drawings. Modifications remain possible, particularly as to the construction of the various elements or by substitution of technical equivalents, without thereby departing from the scope of protection of the invention.

The invention claimed is:

1. A process for the automatic removal of packages of yarn from a winding station of a yarn winding machine, comprising:

a) mounting a spool on a spool holding device;

b) winding yarn onto the spool using a package drive until a full package of yarn is obtained;

c) guiding the yarn to be wound during winding using a package guide;

d) relaxing tension on a supply of yarn to the spool when a full package is stopping rotation;

e) removing the full package from the spool holding device; and f) repeating steps a)–e) with a new spool, wherein the relaxing tension is carried out, by driving the full package in a direction opposite to a direction of winding by rotating the package drive in a reverse mode of operation.

2. The process according to claim 1, wherein the relaxing tension is carried out upon total stoppage of the full package.

3. The process according to claim 1, wherein the relaxing tension is carried out after total stopping of the full package.

4. The process according to claim 1, wherein the relaxing tension is carried out during stopping of winding, before removing the full package.

5. The process according to claim 1, wherein the relaxing tension is carried out during stopping of winding, during removal of the full package.

6. The process according to claim 1, wherein the relaxing tension is carried out during stopping of winding, immediately after removal of the full package.

7. The process according to claim 1, wherein the relaxing tension is carried out upstream in a direction of winding of the winding station.

* * * * *